US005357829A

United States Patent [19]

Schur et al.

[11] Patent Number: 5,357,829

[45] Date of Patent: Oct. 25, 1994

[54] ANTENNA ELEMENT PLIERS

[75] Inventors: Richard E. Schur, Greencastle, Pa.; Clyde W. Ankeney, Jr., Hagerstown, Md.

[73] Assignee: The United States of America as represented by the Secretary of the Army, Washington, D.C.

[21] Appl. No.: 961,804

[22] Filed: Oct. 16, 1992

[51] Int. Cl.[5] ..... B25B 7/02

[52] U.S. Cl. ..... 81/418; 81/424.5

[58] Field of Search ..... 81/418, 424.5, 421; 29/268

[56] References Cited

U.S. PATENT DOCUMENTS

| | | | |
|---|---|---|---|
| 3,964,148 | 6/1976 | Sturtevant | 81/418 X |
| 4,157,594 | 6/1979 | Raabe | 81/424.5 X |
| 4,730,524 | 3/1988 | Petersen | 81/418 X |
| 4,865,032 | 9/1989 | Jones | 81/418 X |

*Primary Examiner*—James G. Smith

*Attorney, Agent, or Firm*—Saul Elbaum; Edward Stolarun

[57] ABSTRACT

Pliers having opposed gripping tips thereon wherein each gripping tip is configured as a tooth which extends toward the opposite gripping tip.

5 Claims, 2 Drawing Sheets

ANTENNA ELEMENT PLIERS

BACKGROUND OF THE INVENTION

1. Field of the Invention

The present invention relates to pliers for gripping and holding articles and more particularly to pliers for extracting antenna elements from an antenna panel.

2. Description of the Prior Art

The antenna to the PATRIOT missile system includes a panel having a matrix array of deep, generally cylindrical-shaped, receptacles therein. The receptacles retain plug-in electronic components known as antenna elements or radar elements. Each antenna element has a cylindrical head having a pair of spaced apart circumferential channels therein, which accomodate a retaining ring to insure a snug, stable fit and a sealing ring for weatherproofing purposes. The portion of the head which extends out from the receptacle includes another circumferential channel therein which serves as a gripping channel to facilitate removal of the antenna element.

The overhaul of the antenna to the PATRIOT missile system requires the removal of all of the antenna elements from the antenna panel. Since each panel contains a total of 5,463 receptacles and associated antenna elements, removal of the antenna elements was a tedious, time consuming process which was undertaken one by one with a costly, specially designed puller assembly. Approximately four worker days were consumed to complete the removal of all antenna elements from an antenna panel using the puller assembly.

The puller assembly was a somewhat complex and costly mechanism which included a base adapted to abut the panel in a predetermined orientation and encompass the head of the antenna element, three spring tensioned fingers extendable into firm engagement with the gripping channel at three predetermined points 120 degrees apart, and a worm gear mechanism to slowly withdraw the antenna element from the receptacle. The puller assembly worked reasonably well under favorable conditions, but less so under the conditions generally encountered during an overhaul.

Since the antenna to be overhauled was used in all-weather environments it was subjected to the harmful effects of wind, rain, dust, and dirt over extended periods of time such that during the overhaul, many of the antenna elements were frozen in place and difficult to remove, primarily because of the grit and grime that had become embedded proximate the sealing ring. Under such circumstances, use of the puller assembly was likely to result in damage to the head of the antenna element during removal such that it was no longer usable. In numerous instances the puller assembly would fail to extract the damaged antenna element since the spring tensioned fingers would only engage the gripping channel at the three predetermined points which, after being stripped by a failed extraction effort, no longer provided a lifting surface for the fingers to adequately engage. On average, use of the puller assembly resulted in approximately 400 antenna elements being damaged for each panel being overhauled, which was unacceptably high, especially in view of the high replacement cost for damaged antenna elements.

SUMMARY OF THE INVENTION

Accordingly, it is an object of the invention to significantly reduce the time required to remove antenna elements from antenna panels.

It is another object of the invention to reduce the amount of damage to antenna elements during the removal process.

Still another object of the present invention is to construct pliers having improved gripping tips.

Yet another object of the invention is to facilitate removal of antenna elements from an antenna structure by the use of specially adapted pliers.

The present invention is summarized in pliers for gripping an object including a handle, jaw means extending from the handle, another handle, jaw means extending from the other handle, means interconnecting the handles for relative movement to thereby effect relative movement of the respective jaw means, the jaw means being aligned in opposition such that the relative movement thereof is an opening and closing actuation, each of the jaw means having a gripping tip extending therefrom, each of the gripping tips extending beyond its respective jaw means in a direction toward the other gripping tip, and the gripping tips being relatively movable toward each other wherein an object may be gripped thereby.

Other objects and advantages of the present invention will be more fully apparent from the following description of the preferred embodiment when taken in conjunction with the accompanying drawings.

DESCRIPTION OF THE PREFERRED EMBODIMENT

Figure 1:
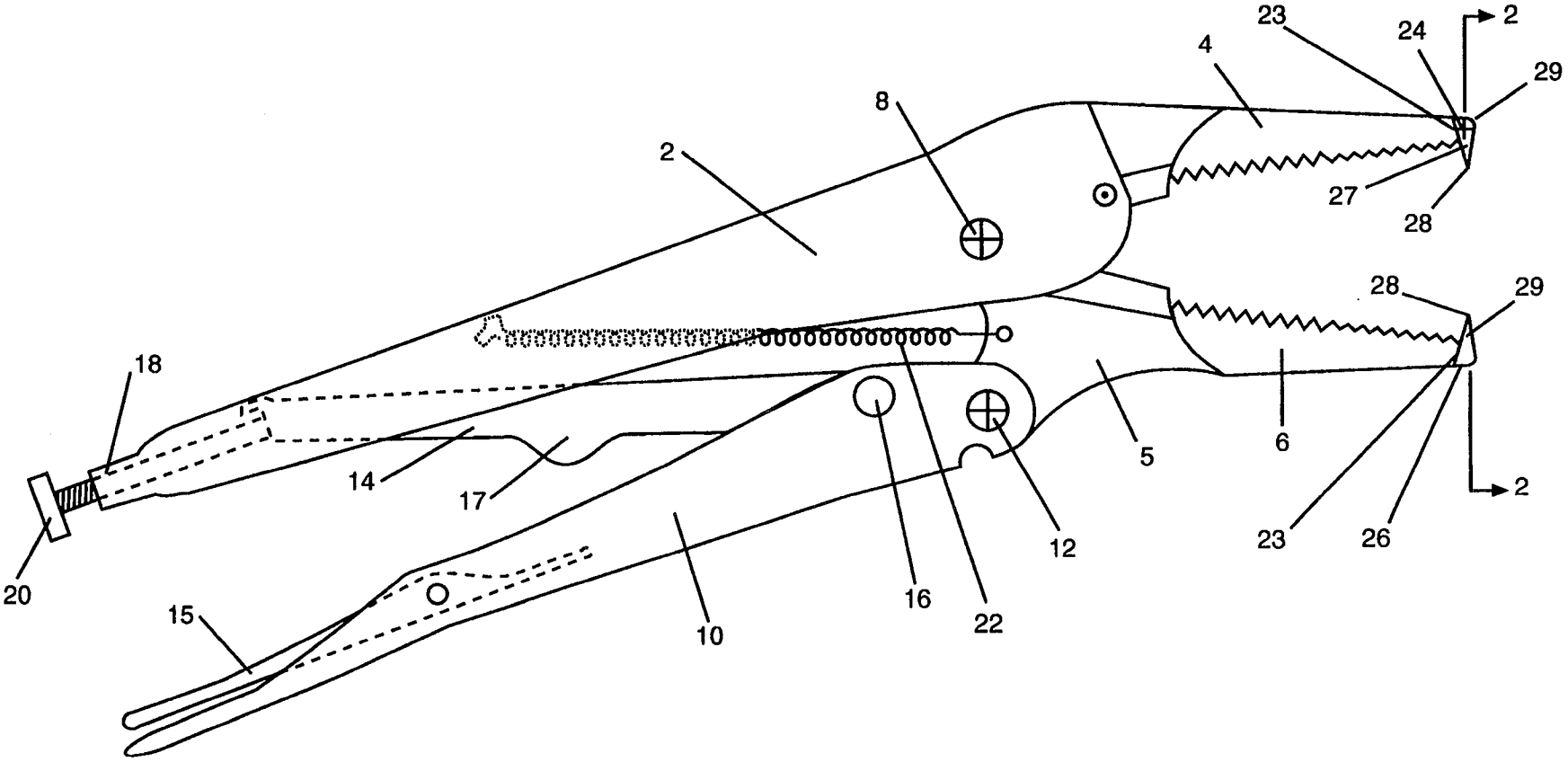
FIG. 1 is a side elevation view of pliers in accordance with the present invention.

Referring to FIG. 1, pliers in accordance with the present invention, which typically can be made of steel or other suitable materials commonly associated with pliers construction, include an elongate handle 2 having a fixed jaw 4 extending from an end thereof in generally longitudinal alignment therewith. Handle 2 is hollowed to form a generally U-shaped channel which extends substantially the length thereof. A jaw base 5 having a movable jaw 6 extending therefrom extends into the channel and is pivotally attached to handle 2 proximate jaw 4 by a pivot 8. A movable handle 10, which is hollow to form a generally U-shaped channel which extends substantially the length thereof, is pivotally attached to jaw base 5 by pivot 12.

An adjustment bar 14 extends from within the channel of handle 2 into the channel of handle 10, and is pivotally attached to handle 10 by a pivot 16. The adjustment bar 14 includes a boss 17 which serves as a stop to limit closure of the pliers. Handle 10 also includes a pivotal release lever 15 which can selectively apply pressure to bass 17 to retract the pliers from a locked gripping position. Handle 2 includes a collar 18 at an end thereof opposite the jaw end. The collar 18 contains internal screw threads to receive an adjustment screw 20 which extends into handle 2 into contact with adjustment bar 14. The connection of the adjustment screw 20 and the adjustment bar 14 forms a pivot joint which is movable axially along handle 2 in accordance with the setting of adjusting screw 20 and about which adjustment bar 14 is capable of rotating. A tension spring 22 is retained at one end thereof by an aperture in the base of jaw 6 and at its other end by a retainer disposed within the channel of handle 2. The tension spring maintains tension through the jaw base 5 and jaw 6, handle 2, and adjusting bar 14 to maintain the pivot joint connection between the adjusting bar 14 and the adjusting screw 20, and tends to retain jaw 6 in an open or retracted position relative to jaw 4.

Figure 2:
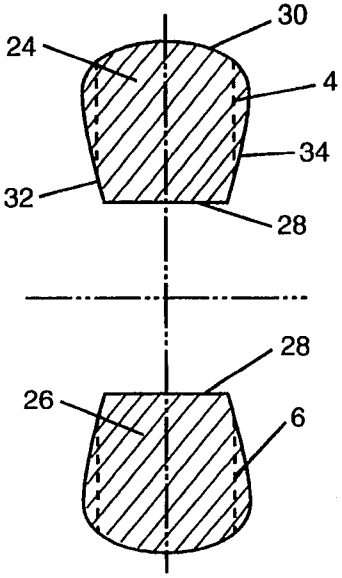
FIG. 2 is an enlarged cross section view of a gripping tip taken along the line 2—2 of FIG. 1.

Each of jaws 4 and 6 have a nose-end termination 23 and a gripping tip 24 and 26, respectively, disposed at each nose-end termination 23 and extending transverse to the longitudinal axis of the jaws 4, 6 in opposed symmetry. Each nose-end termination 23 is a generally flat surface oriented at a slant relative to the longitudinal axis of its respective jaw 4, 6. As shown in FIGS. 1 and 2, the gripping tips 24, 26 are generally configured as wedges and are oriented on opposed ends of jaws 4, 6 such that thickest portion of each wedge is permanently attached to its respective jaw, such as by a weld bond in the case of weldable materials such as steel or an appropriate adhesive in the case of materials not adapted for welding. Alternatively, the gripping tips 24, 26 may be composed entirely of a build-up of weld which thereafter can be ground to the proper configuration. Each gripping tip is shaped, such as by grinding, to a rounded corner configuration as shown at 29.

The wedge configuration of gripping tips 24, 26 is oriented such that the angled side of the wedge mates with a similarly angled face of each nose-end 23 of the associated jaws 4, 6. This slanted, or angled, interface is advantageous because it affords a larger bonding area at the interface of the jaw and gripping tip resulting in a stronger bond and a hand tool less prone to tip breakage.

Each gripping tip 24, 26 includes a tooth-like portion 27 having a gripping edge 28 termination. The tooth-like portion 27 extends beyond its associated jaw 4, 6 toward its opposite gripping tip 26, 24 such that a complete closure of jaws 4, 6 would result in an aligned joining of the gripping edges 28. For the greatest strength and durability of the pliers, it is desirable that the thickness of the gripping edges 28 should be the maximum thickness necessary to completely reach the innermost depth of the gripping channel of the antenna element to be removed. Further reductions in this maximum thickness may occur as a matter of design but such greater reductions in thickness will inherently result in more fragile tips, which may be compensated for by the use of stronger material for gripping tips 24, 26.

As shown in FIG. 2, each of gripping tips 24, 26 has an arcuate crown 30 in the shape of a half-circle, which generally coincides with the shape of the associated jaw 4, 6 from which the gripping tip 24, 26 extends. The diameter of the crown 30 exceeds the width of the associated jaws 4, 6 resulting in each gripping tip having a width greater that the width of its associated jaw 4, 6. The arcuate crown 30 transitions to opposed, inwardly slanting sides 32, 34 which extend beyond the jaws 4, 6 and are terminated by a straight gripping edge 28. The gripping edge 28 extends perpendicular to both the longitudinal axis of the pliars as well as to the intended relative line of movement of the gripping tips 24, 26 during use of the pliers.

Figure 3:
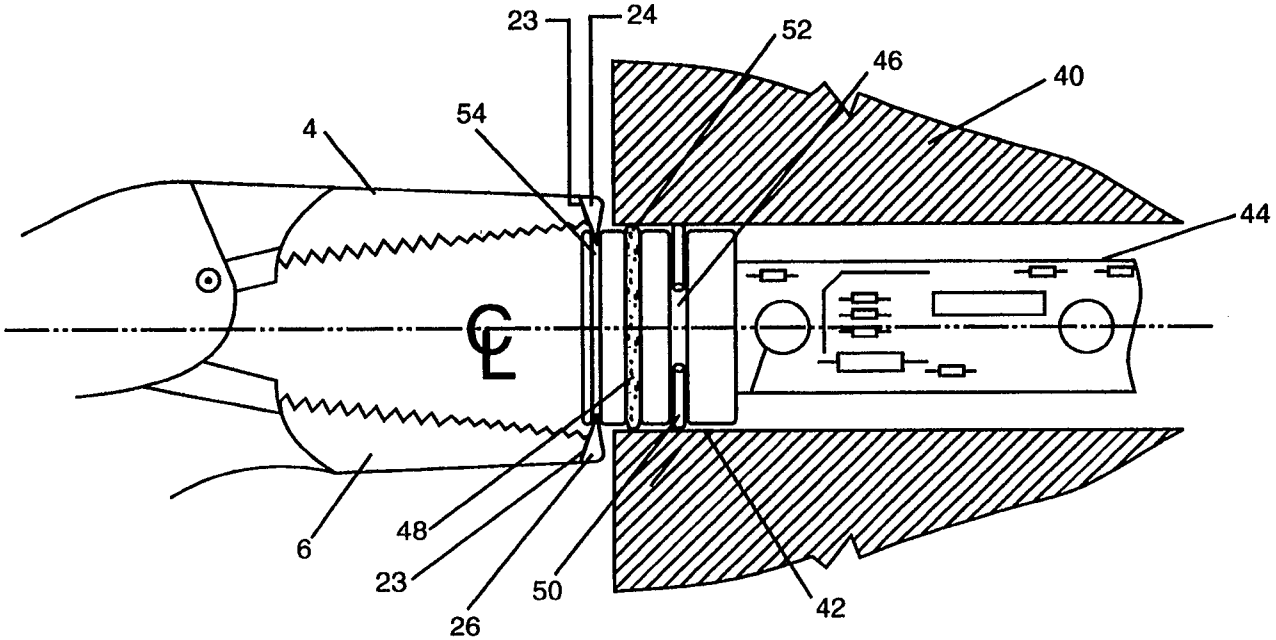
FIG. 3 is a side elevation view with part in cross section of the pliers of FIG. 1 in engagement with an antenna element to be removed.

In FIG. 3 is shown a portion of an antenna to be overhauled including an antenna panel 40, shown in cross section and partially broken away, having a generally cylindrical receptacle 42 therein. Receptacle 42 contains an antenna element 44 to be removed during overhaul, including a cylindrical head 44 with spaced apart circumferential channels 46 and 48 which contain a retaining ring 50 and a sealing ring 52, respectively. Both the retaining ring 50 and the sealing ring 52 snugly abut the interior wall of receptacle 42. A portion of head 44 extends out of antenna panel and includes a circumferential gripping channel 54 therein. The jaws 4, 6 and associated gripping tips 24, 26 of the pliers of FIG. 1 are shown positioned to remove the antenna element 44, with the gripping tips 24, 26 interfitting with the gripping channel 54 of head 44 at opposed sections thereof.

In use of the pliers to extract an antenna element from an antenna panel, the portion of handle 10 which is opposite the jaw end is manually moved toward handle 2 in a generally pivoting action about pivot 16. Simultaneously, the adjustment bar 14 pivots toward handle 2 about the pivot point formed by the juncture of the adjusting screw 20 and the adjustment bar 14, causing a generally clockwise rotation of that portion of the handle 10 between pivots 12 and 16. This results in a counter-clockwise rotation of jaw base 5 and jaw 6 about pivot 8 to effect the relative closure of jaws 4, 6 and associated gripping tips 24, 26 into firm engagement with any two 180 degree opposed points within the gripping channel 54 of the antenna element 44.

This general actuation of the pliers is that typically associated with that category of pliers commonly referred to as vice-grip type pliers.

Upon making firm engagement of the pliers with antenna element 44, a slight rotation of the pliers is effected to free up the often frozen connection between the retaining ring 50 and the sealing ring 52 with the receptacle 42. Thereafter, the antenna element 44 is simply and quickly withdrawn while retained by the pliers.

The minimum closure gap between the gripping edges 28 of gripping tips 24, 26 is adjustable and may be pre-set to just firmly engage the inner-most diameter part of the gripping channel 54 of the antenna element 44 at two places 180 degrees apart. Adjustability of the minimum closure gap is effected by rotation of adjustment screw 20 to move the adjustment bar 14 along the U-shaped handle 2, thereby changing the position of the movable pivot point formed by the juncture of adjusting screw 20 and adjusting bar 14, and consequently adjusting the position of pivots 12 and 16 to thereby reset the starting position of jaw 6. During closure of jaw 6, handle 10 will ultimately come into abutting contact with boss 17 which acts as a stop, precluding further closure of jaw 6, and the pliers will assume a locked hold upon the antenna element 44 by virtue of the tension produced by the spring 22. Although a minimum closure gap preset for antenna elements 44 would be advantageous in the removal of a successive number of antenna elements 44 since increased efficiencies would be achieved by the reduction of unnecessary manipulation of jaws 4, 6, it is not considered an essential part of the invention since it is contemplated that the invention can also be practiced by other types of pliers without a vice-grip type adjustability feature.

In addition to having constructed and successfully used the above-discussed vice-grip type pliers in a nine inch version, another embodiment of the invention was constructed based upon a ten inch slip-joint plier configuration having the gripping tips shown in FIGS. 1 and 2 which also produced superior results in the removal of antenna elements when compared to the prior art puller assembly. Exemplary dimensions of the constructed gripping tips 24, 26 in both embodiments are as follows:

length of taper—0.31 inches
maximum thickness of taper—0.156 inches
minimum thickness of taper at gripping edge—0.031 inches
radius of rounded corner (29)—0.063 inches
width of gripping edge—0.188 inches
radius of arcuate crown (30)—0.156 inches
angle of sides between crown and gripping edge—19 degrees Pliers have been disclosed which are simplified and inexpensive to produce, yet produce the greatest reliance in the extraction of antenna elements with little or no breakage of costly antenna elements. Pliers in accordance with the present invention have been used to successfully remove in excess of 20,000 antenna elements from antenna panels without a single antenna element breakage.

Inasmuch as the present invention is subject to many variations, modifications and changes in detail, it is intended that all matter contained in the forgoing description or shown in the accompanying drawings shall be interpreted as illustrative and not in a limiting sense.

What is claimed is:

1. Pliers for gripping an object comprising:
a handle,
jaw means extending from said handle,
another handle,
another jaw means extending from said another handle,
means interconnecting said handles for relative movement to thereby effect relative movement of said respective jaw means,
each of said jaw means having an interior face portion which terminates to define an externally disposed nose-end termination,
said respective jaw means having their interior face portions positioned in opposition such that the relative movement thereof effects movement of the respective interior face portions and associated nose-end terminations toward and away from each other,
each of said jaw means having a gripping tip affixed to said nose-end termination,
each of said gripping tips extending beyond its respective jaw means in a direction toward the other gripping tip,
said gripping tips being relatively movable toward each other by their respective jaw means into a generally coplanar object gripping position,
the nose-end termination of at least one jaw means defining a generally planar surface oriented at a slant from the direction of movement of its associated gripping tip, and
the gripping tip being attached to the nose-end termination at the slant.

2. The invention of claim 1 wherein:
each gripping tip has a tooth-like configuration.

3. The invention of claim 1 wherein:
the gripping tip is a wedge having a slanted surface, and
the slanted surface of the wedge is affixed to the slant of the nose-end termination.

4. The invention of claim 3 wherein:
the shape of the gripping tip in a direction transverse to the longitudinal axis of the jaw means is defined by an arcuate crown which transitions to inwardly slanted sides extending beyond the jaw means which terminate at a transverse gripping edge.

5. The invention of claims 4 or 1 wherein said means interconnecting said handles for relative movement comprises:
a pivot on said handle at an end proximate the jaw means,
another pivot on said another handle at an end proximate the jaw means,
means pivotally linking the pivots on said handles,
an adjusting bar interconnecting with each of said handles at intermediate sections thereof,
an adjusting screw in said handle in abutting relationship with said adjusting bar to form a movable pivot therewith, and
said adjusting bar having a fixed position pivot link with said another handle.

* * * * *